US009889676B2

(12) United States Patent
Suzuki

(10) Patent No.: US 9,889,676 B2
(45) Date of Patent: Feb. 13, 2018

(54) PRINTING DEVICE

(71) Applicant: CANON KABUSHIKI KAISHA, Tokyo (JP)

(72) Inventor: Tetsuya Suzuki, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 22 days.

(21) Appl. No.: 15/096,726

(22) Filed: Apr. 12, 2016

(65) Prior Publication Data

US 2016/0303869 A1 Oct. 20, 2016

(30) Foreign Application Priority Data

Apr. 15, 2015 (JP) ..... 2015-083705

(51) Int. Cl.
*B41J 29/38* (2006.01)
*B41J 2/36* (2006.01)
*B41J 2/325* (2006.01)

(52) U.S. Cl.
CPC ..... *B41J 2/36* (2013.01); *B41J 2/325* (2013.01)

(58) Field of Classification Search
None
See application file for complete search history.

(56) References Cited

U.S. PATENT DOCUMENTS 5,112,149 A * 5/1992 Suenaga ..... G06K 15/028 346/143
2009/0262179 A1* 10/2009 Blum ..... H04N 1/4072 347/240
2012/0044314 A1* 2/2012 Higuchi ..... B41J 17/32 347/214

FOREIGN PATENT DOCUMENTS

JP 2005-271321 A 10/2005

* cited by examiner

*Primary Examiner* — Matthew Luu
*Assistant Examiner* — Tracey McMillion
(74) *Attorney, Agent, or Firm* — Cowan, Liebowitz & Latman, P.C.

(57) ABSTRACT

Provided is a printing device that has a thermal head that transfers overcoat ink provided on an ink sheet onto the surface of printing paper based on pattern data. The pattern data is data in which a first pattern and a second pattern are arranged alternately in a primary scanning direction and a secondary scanning direction. The first pattern includes a rectangular block of high tonal value pixels, a frame-like group of low tonal value pixels surrounding the rectangular block, and a group of high tonal pixels surrounding the group of low tonal value pixels. The second pattern includes a rectangular block of low tonal value pixels, a group of high tonal value pixels surrounding the rectangular block, and a frame-like group of low tonal pixels surrounding the group of high tonal value pixels.

11 Claims, 10 Drawing Sheets

PRINTING DEVICE

BACKGROUND OF THE INVENTION

Field of the Invention

The present invention relates to a printing device, and particularly relates to a thermal transfer type of printing device.

Description of the Related Art

A technique is known for providing a protective layer (also referred to as an overcoat layer) on the outermost surface of printing paper for the purpose of protecting the printing surface or adjusting the glossiness of the printing surface. For example, Japanese Patent Laid-Open No. 2005-271321 proposes that in a thermal printer that uses printing paper provided with a transparent protective layer over a thermal color-forming layer, heat is applied to the protective layer using a thermal head after recording an image so as to change the glossiness of the protective layer in a regular manner, thereby giving a visual effect.

Japanese Patent Laid-Open No. 2005-271321 is based on the presumption that printing paper provided with a protective layer in advance is used, but there are apparatuses constituted to add a protective layer at the time of printing. Examples of such apparatuses include sublimation printers constituted to transfer a protective layer after printing with colors, inkjet printers for printing with transparent ink for smoothing the surface of paper, and the like.

In particular, in thermal transfer-type printers such as a sublimation printer, the surface texture of a protective layer after being transferred can be controlled by the heating pattern of the head when transferring the protective layer. For example, it is conceivable to improve the visual recognizability of a printed article by making the surface texture of the protective layer rough and suppressing reflection. However, depending on the heating pattern and the heat amount implemented in order to make the surface texture of the protective layer rough, the fusion strength between the protective layer and the resin film that supports the protective layer increases, and insufficient separation occurs, which prevents the protective layer from being transferred to printing paper.

SUMMARY OF THE INVENTION

The present invention has been made in light of such an issue in conventional techniques. The present invention provides a thermal transfer type of printing device that can improve the visual recognizability of printed articles while suppressing insufficient separation of a protective layer.

According to an aspect of the present invention, there is provided a printing device comprising: a thermal head that transfers overcoat ink provided on an ink sheet onto a surface of printing paper; and a controller that causes the thermal head to perform the transfer based on pattern data, wherein the pattern data is data in which a first pattern and a second pattern are arranged alternately in a primary scanning direction and a secondary scanning direction, the first pattern includes a rectangular block of high tonal value pixels, a frame-like group of low tonal value pixels surrounding the rectangular block, and a group of high tonal pixels surrounding the group of low tonal value pixels, and the second pattern includes a rectangular block of low tonal value pixels, a group of high tonal value pixels surrounding the rectangular block, and a frame-like group of low tonal pixels surrounding the group of high tonal value pixels.

According to another aspect of the present invention, there is provided a printing device comprising: a thermal head that transfers overcoat ink provided on an ink sheet onto a surface of printing paper; and a controller that causes the thermal head to perform the transfer based on pattern data, wherein the pattern data is data in which a first pattern and a second pattern are arranged alternately in a primary scanning direction and a secondary scanning direction, the first pattern includes a rectangular block of high tonal value pixels and a frame-like group of low tonal value pixels surrounding the rectangular block, and the second pattern includes a rectangular block of low tonal value pixels, and a group of high tonal value pixels surrounding the rectangular block.

According to a further aspect of the present invention, there is provided a printing device that transfers overcoat ink provided on an ink sheet onto a surface of printing paper by printing the overcoat ink using pattern image data, wherein the pattern image data is constituted by first pixels having a tonal value that causes the overcoat ink to be fused with the printing paper, and second pixels having a tonal value that is lower than that of the first pixels and causes the overcoat ink to be fused with the printing paper, within the total of pixels constituting the pattern image data, a percentage of the first pixels and a percentage of the second pixel are each 40% or more, each pixel line in a primary scanning direction of the pattern image data includes at least one area in which two or more first pixels are consecutive, and a percentage of an area in which the first pixels are consecutive in a secondary scanning direction within the pattern image data is less than 50%.

Further features of the present invention will become apparent from the following description of exemplary embodiments with reference to the attached drawings.

DESCRIPTION OF THE EMBODIMENTS

Exemplary embodiments of the present invention will now be described in detail in accordance with the accompanying drawings. Here, an example is described in which the present invention is applied to a sublimation printer as an example of a printing device, but the present invention can be applied to any printer that can form a protective layer by a thermal transfer method.

Figure 1:
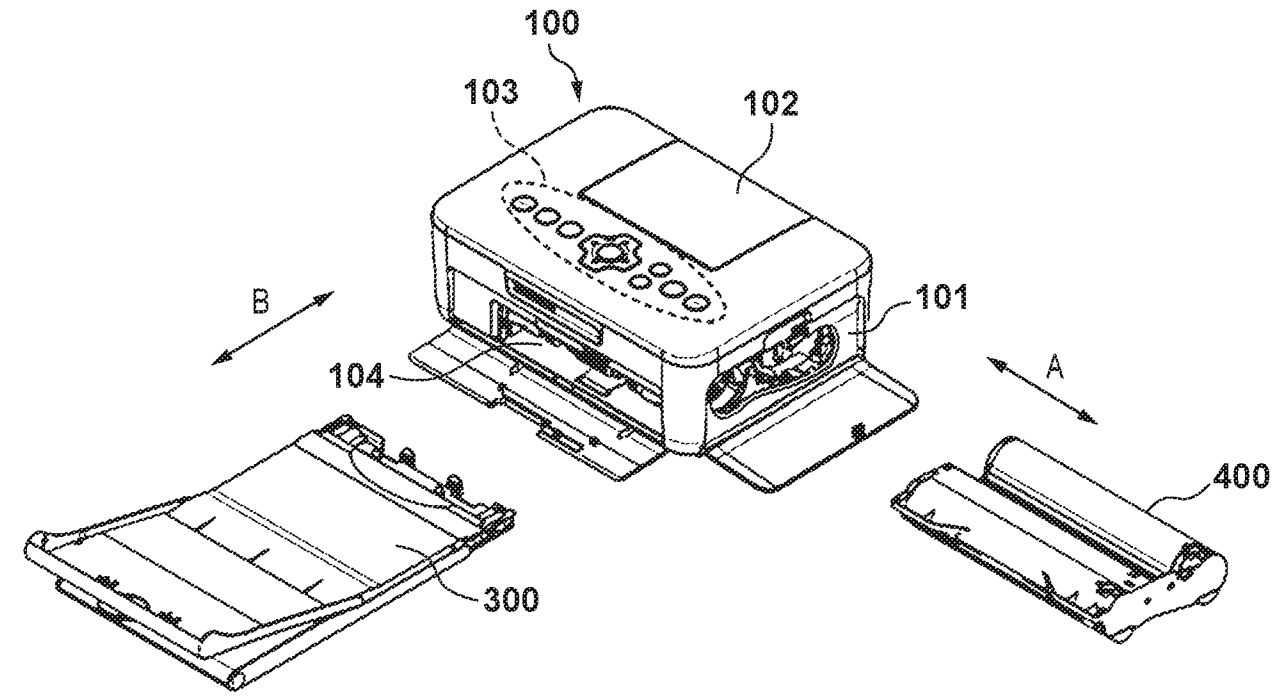
FIG. 1 is a perspective view showing an appearance example of a sublimation printer according to an embodiment.

FIG. 1 is a perspective view showing an appearance example of a sublimation printer according to this embodiment.

FIG. 1 shows a state in which a printing paper tray 300 and an ink cassette 400 have been removed from a printer 100. The ink cassette 400 is detachable from a compartment 101 provided on the side of the printer 100 casing, in a direction indicated by an arrow A. The printing paper tray 300 is detachable from a compartment 104 provided on the front side of the printer 100, in the direction of an arrow B.

A display unit 102 and an operation unit 103 are provided on the top surface of the printer 100 casing. The display unit 102 is an LCD, for example, and displays a screen for selecting an image to be printed and setting a printing condition, a screen for displaying printer information, and the like. The operation unit 103 (including a touch panel in the case where the display unit 102 is a touch display) is constituted by switches and buttons for a user to give instructions to and set settings of the printer 100, and the like.

Figure 2:
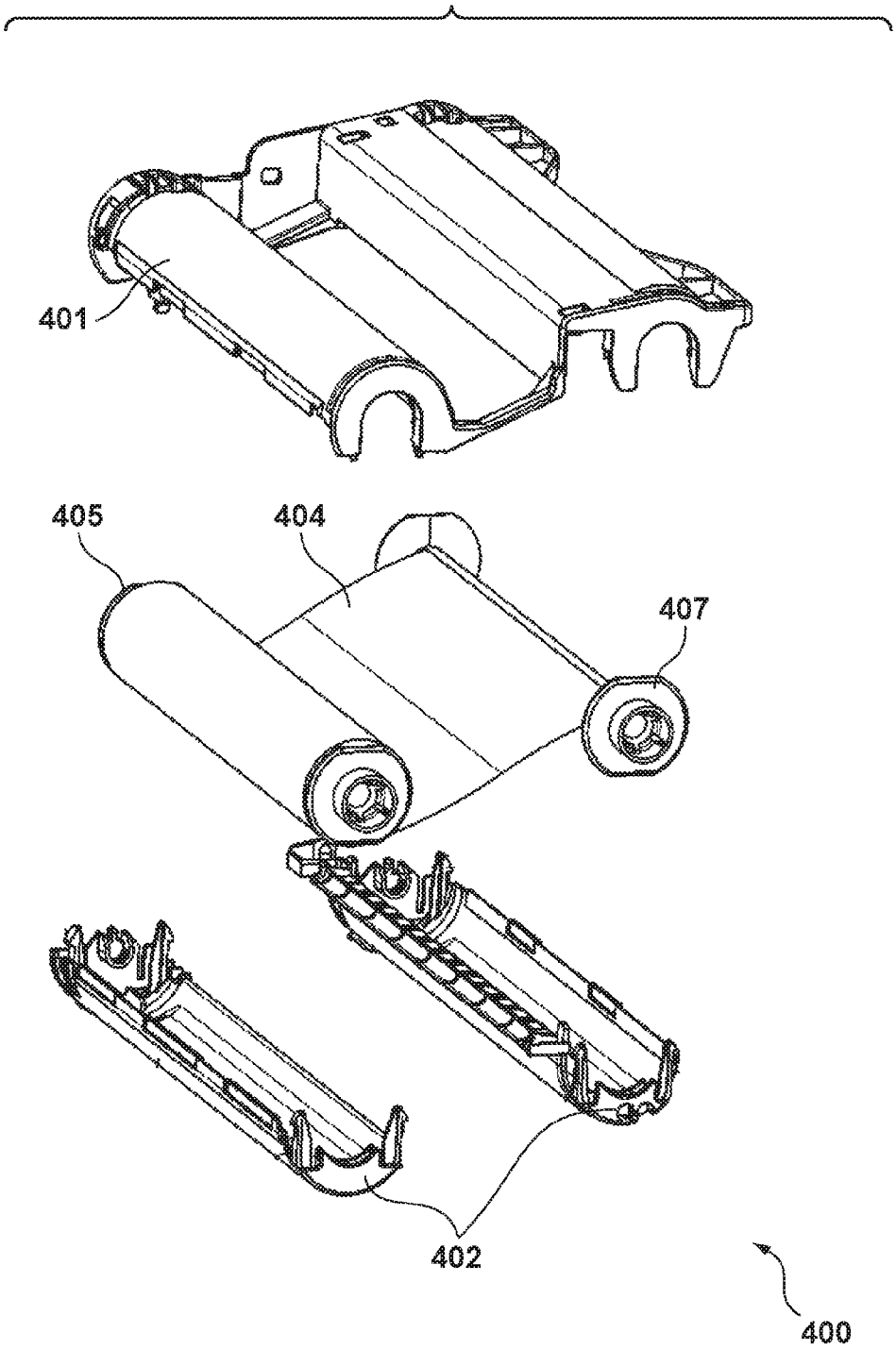
FIG. 2 is an exploded perspective view showing a configuration example of an ink cassette.

FIG. 2 is an exploded perspective view showing a configuration example of the ink cassette 400.

The ink cassette 400 has an upper holder 401, a lower holder 402, an ink sheet 404, a supplying bobbin 405, and a winding bobbin 407. One end of the ink sheet 404 is fixed to the supplying bobbin 405, and the other end is fixed to the winding bobbin 407. The supplying bobbin 405 and the winding bobbin 407 are rotatably held by a bearing structure formed by the upper holder 401 and the lower holder 402. When the ink cassette 400 is mounted to the compartment 101, the shafts of the supplying bobbin 405 and the winding bobbin 407 are fitted into a driving mechanism of the printer 100.

Figure 3A:
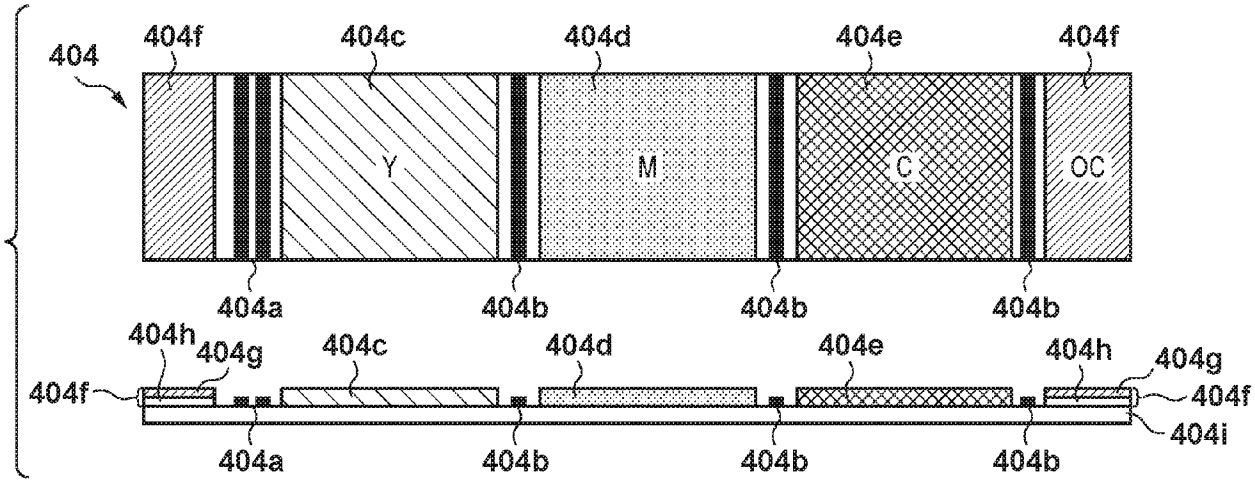
FIGS. 3A and 3B are diagrams showing a configuration example of an ink sheet and a configuration example of a printer.

FIG. 3A is a top view and a side view showing a configuration example of the ink sheet 404, and approximately one unit of repetition in ink arrangement is shown here. The ink sheet 404 has a configuration in which a plurality of color ink layers and a protective ink (also referred to as an overcoat ink) layer are repeatedly arranged on a continuous sheet-like base material in a predetermined order in the length direction. Markers for detection are also arranged in boundary portions between colors of ink and boundary portions between the units of repetition.

A base material 404*i* is formed of a resin sheet. A start position marker a 404*a* is a marker indicating the boundary portion between the units of repetition, and a start position marker b 404*b* is a marker indicating the boundary portion between colors of ink. Yellow ink (Y) 404*c*, magenta ink (M) 404*d*, cyan ink (C) 404*e*, and a protective ink or overcoat ink (OC) layer 404*f* constitute one unit of repetition. The protective ink layer 404*f* is comprised of a heat bonding layer 404*g* that is heat-bonded to printing paper, which is an example of a recording medium, and a protective sheet 404*h*. The ink layers including the protective ink layer, and the markers are formed by coating the base material 404*i* with a material for each of the layers in a sheet-like manner.

Figure 4:
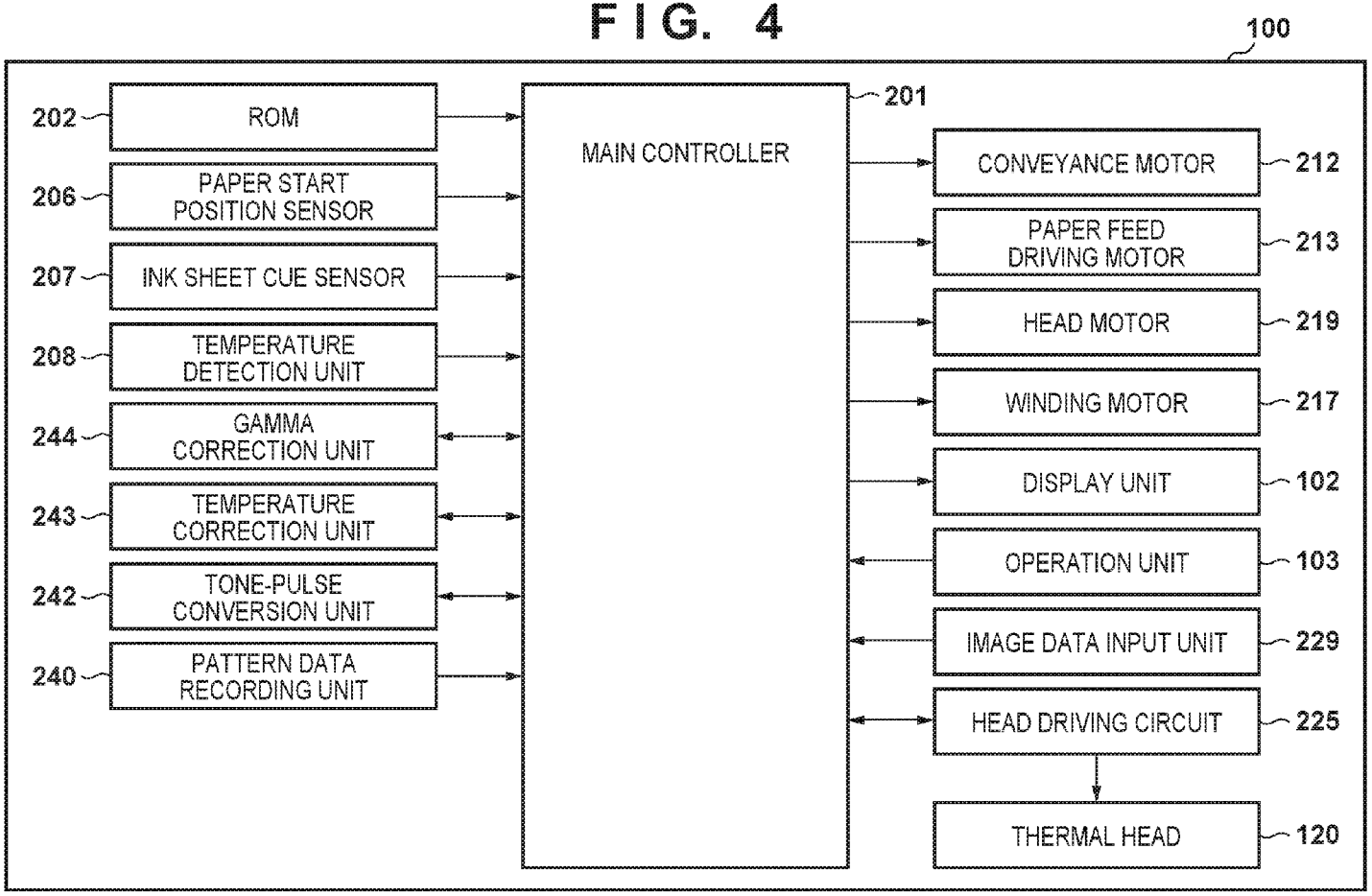
FIG. 4 is a block diagram showing an example of a functional configuration of a printer.

FIG. 4 is a block diagram showing an example of the functional configuration of the printer 100.

A main controller 201 is provided with a programmable processor (ex. a CPU or an MPU), a ROM, and a RAM, for example. The main controller 201 controls the operations of the units of the printer 100 by deploying a program stored in the ROM to the RAM and executing the program using the programmable processor, thereby realizing various functions of the printer 100.

A paper feed driving motor 213 drives a paper feeding roller 133, a conveyance motor 212 drives a conveyance roller 131, and a winding motor 217 drives the winding bobbin 407. A head motor 219 causes a thermal head 120 to move between a position at which the thermal head 120 comes into contact with a platen roller 130 (printing position) and a position at which the thermal head 120 is separated from the platen roller 130 (standby position).

A paper start position sensor 206 detects that the edge of printing paper 301 has reached a predetermined position. In addition, an ink sheet start position sensor 207 detects that the start position marker a 404*a* and the start position marker b 404*b* of the ink sheet 404 have reached predetermined positions. The paper start position sensor 206 and the ink sheet start position sensor 207 may be optical sensors, for example.

An image data input unit 229 is a memory card slot, for example, and can read image data recorded in a memory card mounted thereto and the like. Note that alternately or additionally, the image data input unit 229 may have a configuration in which image data is obtained from an external device through wireless communication, wired communication or the like.

A ROM 202 stores a temperature correction table used for driving pulse correction that depends on the temperature of the thermal head 120, data of screens to be displayed on the display unit 102, and various types of data used by the main controller 201 such as print settings. Note that the ROM 202 may be included in the main controller 201.

A tone-pulse conversion unit 242 converts image data to be printed into pulse data for driving the thermal head 120. In this embodiment, it is assumed that the tone-pulse conversion unit 242 generates 256-tone (8 bit) pulse data for each color component. Transfer energy is smallest at a tonal value of 0 that is the lowest tone, and transfer energy is largest at a tonal value of 255 that is the highest tone.

A temperature detection unit 208 detects the environmental temperature of the vicinity of the thermal head 120, for example. A temperature correction unit 243 corrects the pulse data generated by the tone-pulse conversion unit 242 using the temperature correction table stored in the ROM 202. A gamma correction unit 244 applies correction that depends on a predetermined gamma property to the pulse data after the temperature correction. The main controller 201 controls a head driving circuit 226 using the pulse data after the gamma correction so as to heat the thermal head 120.

A pattern data recording unit 240 is a non-volatile memory, and stores the data of a pattern image for forming a protective layer, which will be described later. Note that the pattern image stored in the pattern data recording unit 240 may be partial image data corresponding to a unit of repetition, or may be image data corresponding to the entire surface of printing paper. In this embodiment, assume that the data of a pattern image is 256-tone (8 bit) data similarly to the pulse data. As will be described later, the pattern data recording unit 240 stores at least the data of a pattern image for matte finish that suppresses glossiness. The data of a pattern image for gloss finish may or may not be stored.

In this embodiment, the data of the pattern image for gloss finish is data made up of a low tonal value (L), and the data of the pattern image for matte finish is data made up of one high tonal value (H) and one low tonal value (L). The low tonal value (L) used for matte finish and the low tonal value (L) used for gloss finish may be the same or may be different. Assume that specific tonal values for the low tonal value (L) and the high tonal value (H) are determined in advance in accordance with the materials of the base material and the protective sheet of the ink sheet, which will be described later, the heating value of the thermal head, and the like. For example, the low tonal value (L) can be determined within the range of tonal values that are sufficient for heat bonding between the adhesive layer and the printing paper but do not cause fusion of the base material and the protective sheet. The high tonal value (H) can be determined within the range of tonal values that can realize the fusion of the base material and the protective sheet. Note that the high tonal value (H) is not limited to a value that can realize fusion of the base material and the protective sheet by driving a single pixel, and may be a value that can realize fusion of the base material and the protective sheet when driving a plurality of pixels consecutively in a primary scanning direction. In the case of 256-tone data (tonal values 0 to 255), the high tonal value (H) can be determined from the range of 200 to 255, for example, and the low tonal value (L) can be determined from the range of 80 to 120, for example.

Figure 3B:
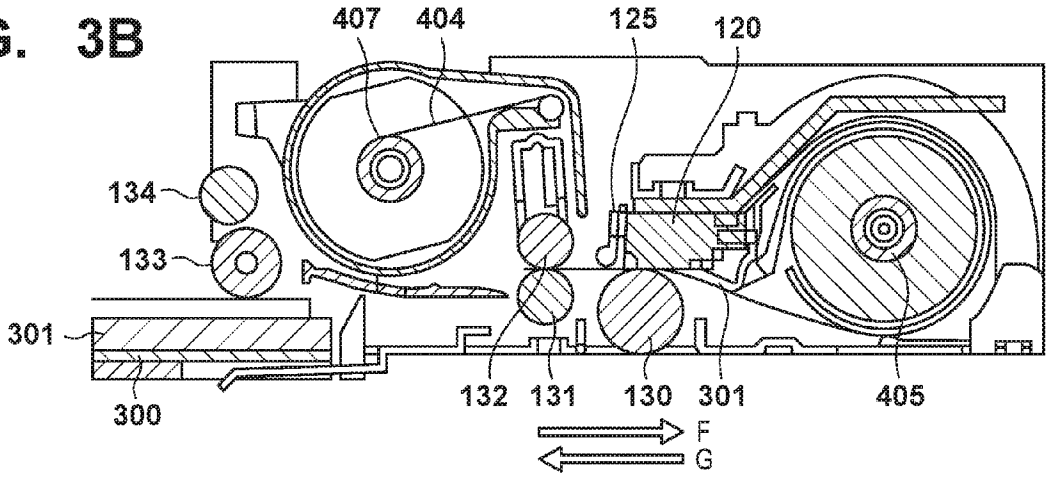

The internal configuration of the printer 100 and the operations of the same at the time of printing will be described with reference to FIG. 4 and FIG. 3B that is a side cross-sectional view of the printer 100. In FIG. 3B, the same reference numerals are given to the configurations described with reference to FIGS. 1 and 2. FIG. 3B shows a state in which the ink cassette 400 has been mounted.

The thermal head 120 has a configuration in which a plurality of resistors are arranged in a line in the primary scanning direction, which is a direction orthogonal to the conveyance direction (secondary scanning direction) of printing paper. Note that in this embodiment, it is assumed that the thermal head 120 is a line head, and has a length that covers the maximum size in the primary scanning direction of the printing paper that is printable with the printer 100. Therefore, in this embodiment, the thermal head 120 does not move in the primary scanning direction, but the thermal head 120 may be configured as a serial head. The main controller 201 controls the driving of the resistors (heating bodies) of the thermal head 120 through the head driving circuit 226. Note that in this embodiment, the thermal head 120 is assumed to have one line worth of resistors, but may have a plurality of lines worth of resistors.

A separation plate 125 is provided for changing the conveyance direction of the ink sheet 404 to a direction that deviates from the conveyance direction of the printing paper. The platen roller 130, the conveyance roller 131, a driven roller 132, the paper feeding roller 133, and a paper discharge roller 134 are rollers for conveying the printing paper along a conveyance route. Note that F indicates a paper feeding direction and G indicates a paper discharge direction in the drawings.

The main controller 201 drives the paper feed driving motor 213, pulls out the printing paper 301 from the printing paper tray 300 using the paper feeding roller 133, and conveys the printing paper 301 in the paper feeding direction F. The main controller 201 also drives the conveyance motor 212, causes the conveyance roller 131 and the driven roller 132 to sandwich the printing paper 301, and conveys the printing paper 301 in the paper feeding direction F to a position at which the leading edge is detected by the paper start position sensor 206 (not illustrated in FIG. 3B). When the leading edge of the printing paper 301 is detected by the paper start position sensor 206, the main controller 201 starts the driving of the winding bobbin 407 using the winding motor 217.

When the ink sheet start position sensor 207 (not illustrated in FIG. 3B) detects the start position marker a 404*a*, the main controller 201 drives the head motor 219 so as to move the thermal head 120 to the printing position at which the thermal head 120 comes in contact with the platen roller 130. When the thermal head 120 has moved to the printing position, the upper surface of the ink sheet 404 and the lower surface of the printing paper 301 are pressed against each other by the thermal head 120 and the platen roller 130. In this state, the main controller 201 heats resistors of the thermal head 120 in the primary scanning direction based on pulse data for yellow data, and transfers the yellow ink layer 404*c* onto the printing paper 301. When one head driving operation in the primary scanning direction ends, the main controller 201 drives the conveyance motor 212 and the winding motor 217, and moves the printing paper 301 and the ink sheet 404 in the secondary scanning direction (the paper discharge direction G) by a predetermined amount. Note that the movement amount in the secondary scanning direction is defined in accordance with how many lines of resistors the thermal head 120 has.

When the printing in the primary scanning direction and the conveyance of the ink sheet 404 and the printing paper 301 in the secondary scanning direction are performed repeatedly, the leading edge of the yellow ink layer 404*c* reaches the separation plate 125. Downstream of the separation plate 125, the conveyance route of the ink sheet 404 and the conveyance route of the printing paper 301 deviate from each other. More specifically, the direction of the conveyance route of the ink sheet 404 changes to upward such that the ink sheet 404 is stripped from the printing paper 301. In particular, at the time of forming (at the time of transferring) the protective layer, the protective sheet 404*h* is separated from the base material 404*i* at the position of the separation plate 125 and is transferred onto the printing paper 301 due to the adhesive force between the adhesive layer 404*g* and the printing paper 301 exceeding the binding force between the protective sheet 404*h* and the base material 404*i*.

When the amount of conveyance in the secondary scanning direction (the paper discharge direction G) reaches the predetermined amount, the main controller 201 drives the head motor 219 so as to move the thermal head 120 to a standby position. The main controller 201 also reverses the driving direction of the conveyance motor 212, and conveys the printing paper 301 back in the paper feeding direction F until the leading edge is detected by the paper start position sensor 206.

The above operations are repeatedly performed for the magenta ink layer 404*d*, the cyan ink layer 404*e* and the protective ink layer 404*f* in this order. Each time the type of ink used for printing changes, the printing paper 301 is conveyed in the paper feeding direction F, and is then conveyed in the paper discharge direction G while being printed on, and thus the color components are sequentially printed on the printing paper 301, and the protective layer is lastly formed. At the time of forming the protective layer, the printing operation is performed using pulse data that is based on the data of a pattern image stored in the pattern data recording unit 240, instead of image data for printing. After forming the protective layer, the main controller 201 drives the paper feed driving motor 213 so as to discharge the printing paper 301 from between the paper feeding roller 133 and the paper discharge roller 134 to the upper portion of the paper tray 300.

Figure 5:
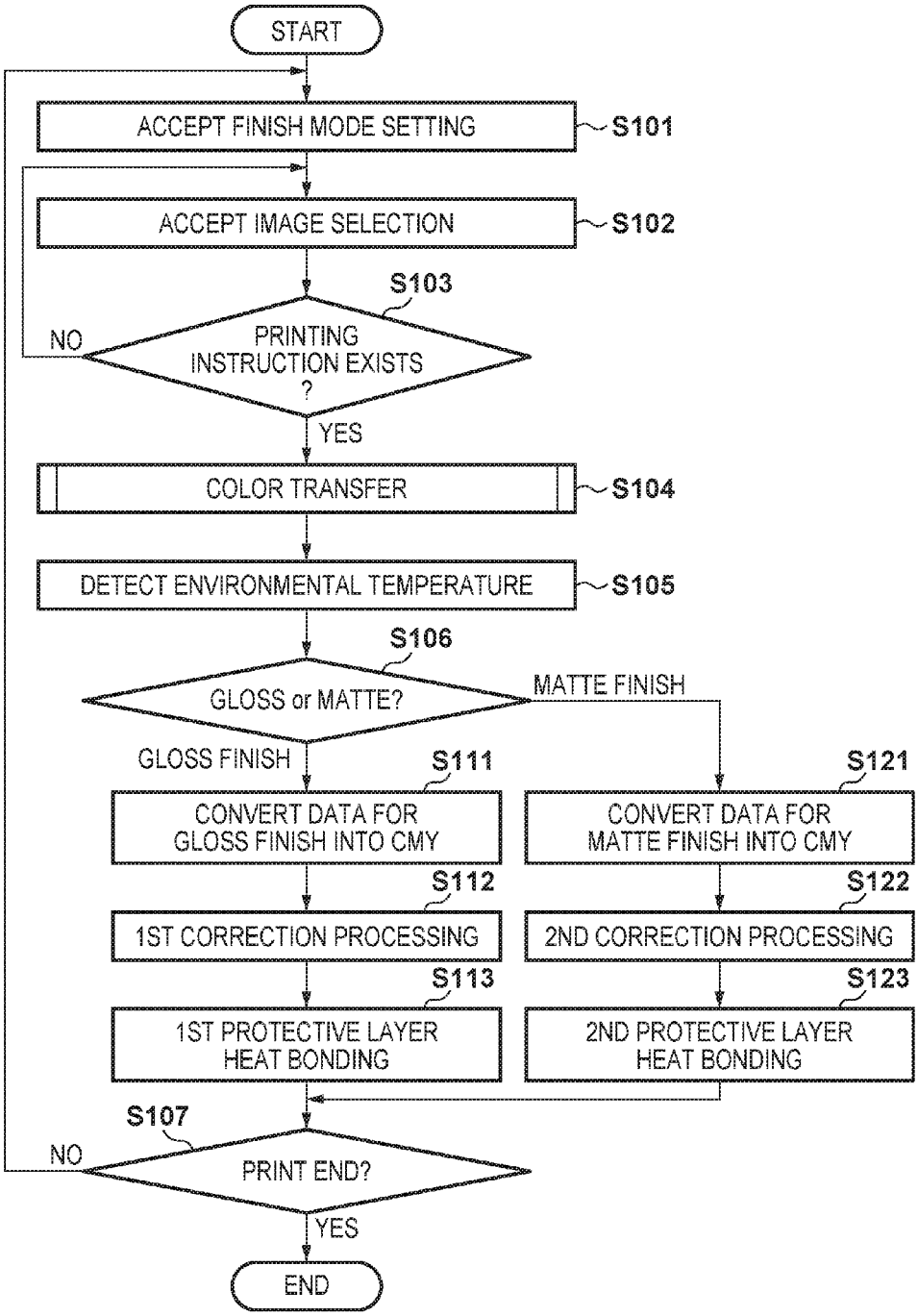
FIG. 5 is a flowchart of printing processing.

Next, the operations of the printer 100 at the time of printing will be further described with reference to a flowchart in FIG. 5. Assume that in the printer 100 of this embodiment, gloss finish or matte (deglossing) finish can be selected as a print option. The main controller 201 forms the protective layer using data of different pattern images when gloss finish is selected and when matte finish is selected.

In step S101, the main controller 201 accepts a finish mode setting as a setting value for a finish mode setting item included in a print setting screen displayed on the display unit 102, for example. Here, assume that either "gloss finish" or "matte finish" has been set.

In step S102, the main controller 201 accepts an instruction to select an image to be printed. For example, the main controller 201 displays, on the display unit 102, a list display screen of image data that exists in, for example, a storage medium mounted to the image data input unit 229. The list display screen may include thumbnails of a plurality of images selectably arranged along with the number of print sets, for example.

In step S103, the main controller 201 determines whether or not a printing instruction has been input through the operation unit 103, and if input of a printing instruction is not detected, returns the procedure to step S102 so as to continue the display of the list display screen. However, if input of a printing instruction is detected, the main controller 201 obtains a selected result in the list display screen and a designated result of the number of print sets, and advances the procedure to step S104.

In step S104, the main controller 201 performs color printing processing. Specifically, the main controller 201 reads out the data of the image selected in step S102 from the storage medium mounted to the image data input unit 229, for example, then applies decoding processing or the like, subsequently converts the data into CMY data, and write the CMY data to an internal memory (RAM). The main controller 201 then generates temperature-corrected and gamma-corrected pulse data from the CMY data using the tone-pulse conversion unit 242, the temperature correction unit 243 and the gamma correction unit 244, as described above. Subsequently, the main controller 201 sequentially performs printing processing for yellow ink layer 404*c*, magenta ink layer 404*d*, and cyan ink layer 404*e*, as described with reference to FIG. 3A.

Steps S105 to S107 are protective layer forming operations.

In step S105, the main controller 201 obtains the environmental temperature from the temperature detection unit 208.

In step S106, the main controller 201 branches the processing so as to advance the procedure to step S111 if gloss finish was set in step S101, and advance the procedure to step S121 if matte finish was set.

In step S111, for example, the main controller 201 converts the data of the pattern image for gloss finish (or the low tonal value (L)) stored in the pattern data recording unit 240 into CMY data, and writes the CMY data to the internal memory. In step S112, the main controller 201 converts the CMY data into pulse data using the tone-pulse conversion unit 242, and then applies temperature correction that is based on temperature correction data for color ink stored in the ROM 202 using the temperature correction unit 243. The main controller 201 further applies gamma correction to the pulse data using the gamma correction unit 244.

In step S113, the main controller 201 performs printing processing for the protective ink layer 404*f* with the same operation as the color printing processing performed in step S104. The printing processing performed in step S113 is the first protective layer heat bonding process. As described above, printing processing with the low tonal value of the pixels constituting the pattern image for gloss finish does not cause fusion of the protective sheet and the base material, and therefore, the surface of the protective sheet separated from the base material (the surface that was in contact with the base material) is not made rough by the printing processing. Therefore, the protective layer having glossiness is formed on the surface of the printing paper, thereby realizing gloss finish.

On the other hand, in the case of matte finish as well, basically the same processing may be performed, except that the type of pattern image to be used for the printing is different. Specifically, in step S121, the main controller 201 converts the data of the pattern image for matte finish stored in the pattern data recording unit 240 into CMY data, and writes the CMY data to the internal memory. In step S122, the main controller 201 converts the CMY data into pulse data using the tone-pulse conversion unit 242, and then applies temperature correction that is based on the temperature correction data for the color inks stored in the ROM 202 to the pulse data using the temperature correction unit 243. As necessary, the main controller 201 may further apply temperature correction that is based on temperature correction data for the protective ink stored in the ROM 202 to the pulse data, using the temperature correction unit 243. Furthermore, the main controller 201 applies gamma correction to the pulse data using the gamma correction unit 244.

The printing processing performed in step S123 is the second protective layer heat bonding step. The printing speed of the printer 100 is lowered below the printing speed at the time of transferring color ink so as to allow heat bonding of the protective layer. Step S107 is a printing ending determination step. Normally, the procedure returns to step S101 so as to wait for the next printing instruction.

In step S123, the main controller 201 performs printing processing for the protective ink layer 404*f* with the same operation as the color printing processing performed in step S104. As described above, the high tonal value (H) of the pixels constituting the data of the pattern image has been determined so as to cause fusion of the protective sheet 404*h* and the base material 404*i*. Therefore, the printing processing brings the base material and the surface of the protective sheet into a fused state in the portion of pixels corresponding to the high tonal value (H). When the protective sheet 404*h* is separated from the base material 404*i* at the position of the separation plate, the fused portion is stripped away, and the surface of the protective sheet 404*h* (the surface that was in contact with the base material 404*i*) is made rough. Therefore, the protective layer 404*h* having rough surface portions is formed on the surface of the printing paper, thereby realizing matte finish. Note that as in the case where fusion of the base material 404*i* and the protective sheet 404*h* cannot be caused by the high tonal value (H) at a normal printing speed, the printing speed at the time of forming the protective layer may be lowered below the speed for the color printing as necessary.

The following describes an event that can be a problem in the case of making the surface of the protective sheet 404*h* rough by heating the heat bonding layer so as to adhere the protective ink layer 404*f* to the surface of the printing paper, and simultaneously fusing the base material 404*i* and the protective sheet 404*h* of the ink sheet 404 by the printing processing.

FIGS. 8A to 8E are diagrams schematically showing the relationship between the arrangement of pixels with a high tonal value (H) in the data of a pattern image and the temperature of a resistor of the thermal head 120. These examples show the resistor (heating body) corresponding to a pixel 6012 that is second from the left in a pixel block 600 constituted by four pixels 6011 to 6014 that are consecutive in the primary scanning direction, and how the temperature of this resistor changes in accordance with the arrangement pattern of the high tonal value (H).

In FIGS. 8A to 8E, the arrangement pattern of the high tonal value (H) is shown on the left, and change in the temperature of the resistor of the thermal head at the position of the pixel 6012 is shown on the right. Reference numeral 605 denotes the temperature at which the protective sheet and the base material are fused (fusing temperature).

Figure 8A:
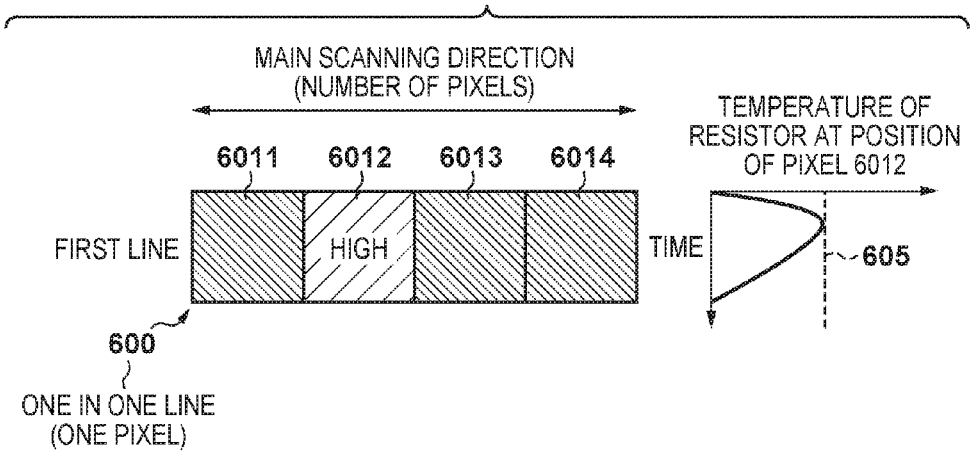
FIGS. 8A to 8E are diagrams each showing an example of the relationship between a pattern image and a heating value of a resistor.
Figure 8B:
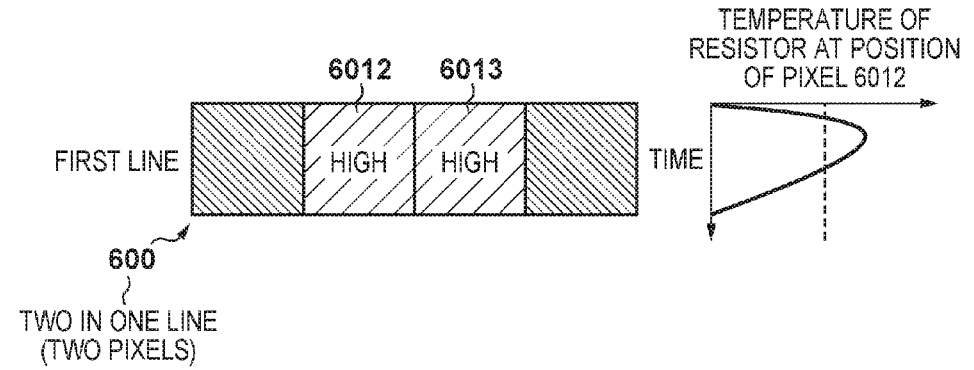
Figure 8C:
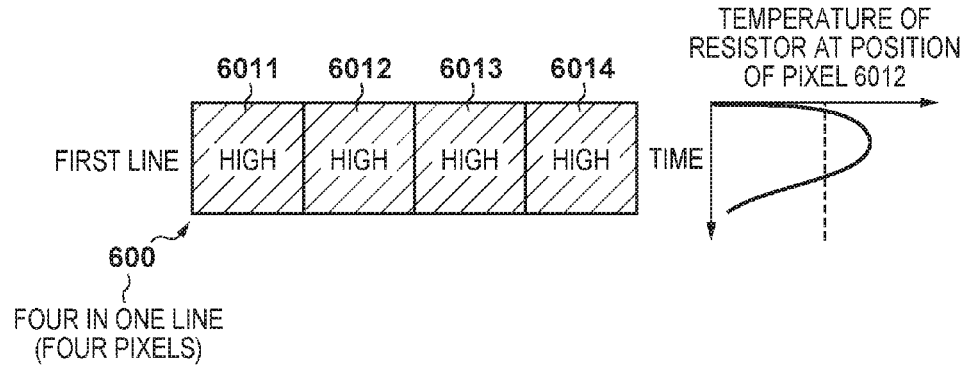
Figure 8D:
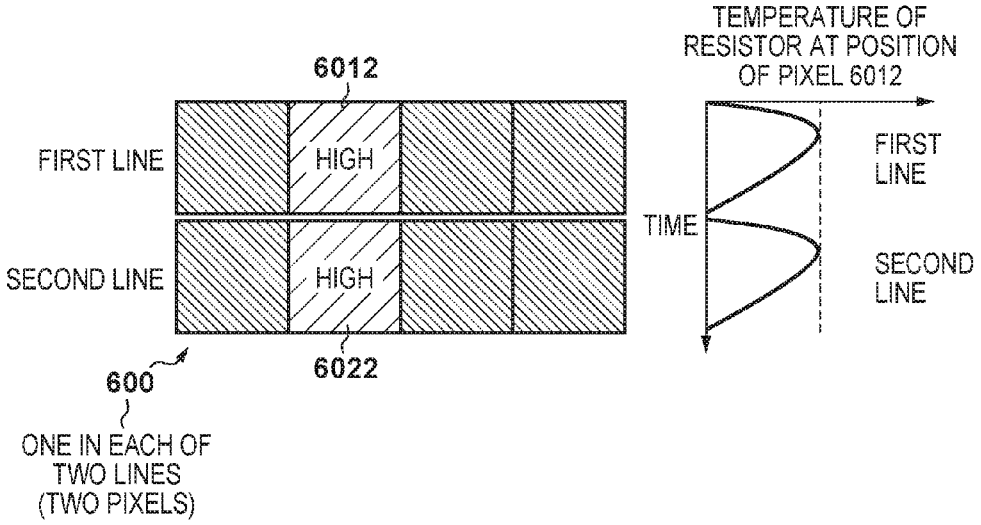
Figure 8E:
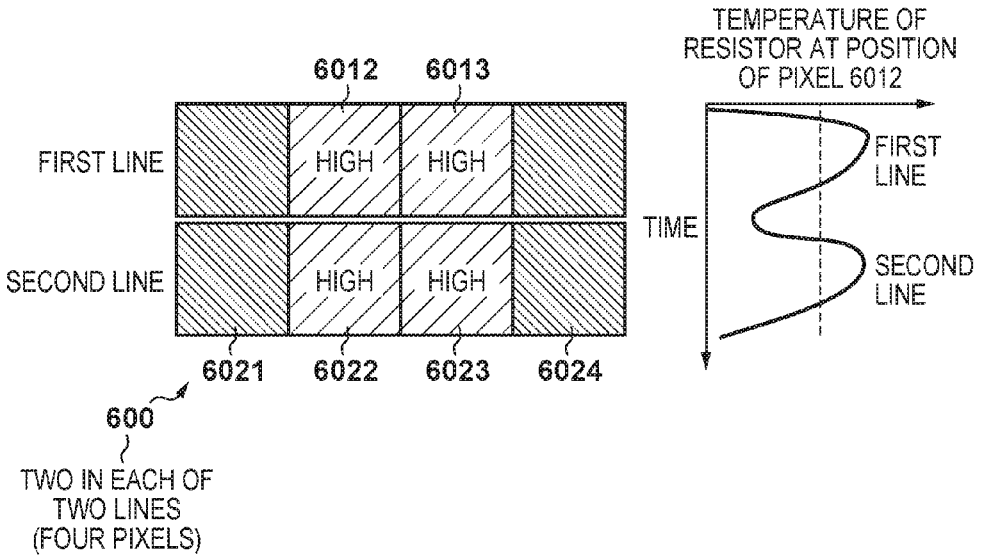

FIGS. 8A to 8C show the case in which there is no influence from driving the thermal head for one or more other pixels with the high tonal value (H) in the secondary scanning direction, or the case where there is no necessity to consider such influence, and FIGS. 8D and 8E show the case in which there is influence from driving the thermal head for one or more other pixels with the high tonal value (H) in the secondary scanning direction.

FIG. 8A shows the case of driving the thermal head 120 with the high tonal value (H) for the pixel 6012 among the pixels 6011 to 6014, and driving the thermal head 120 with a low tonal value (L) for the other pixels 6011, 6013, and 6014. In this example, even if the resistor corresponding to the pixel 6012 is driven with a pulse that corresponds to the high tonal value (H), the fusing temperature 605 is not reached. This is because surrounding resistors are not heated, and therefore the heat generated in the resistor corresponding to the pixel 6012 easily escapes by being conducted to the surrounding resistors. Note that, in order to describe the influence of heat accumulation, assume here that a high tonal value (H) and a printing speed at which fusion does not occur with the pattern in FIG. 8A have been set. However, it should be noted that in actuality, a high tonal value (H) (and additionally a printing speed as necessary) at which fusion occurs with the pattern in FIG. 8A as well can be set.

However, in the case where the pixel 6013 adjacent in the primary scanning direction also has the high tonal value (H) as shown in FIG. 8B, two adjacent resistors are heated at the same time, and therefore the heating efficiency increases. In addition, the amount of heat escaping to the periphery also decreases, and therefore the temperature of the resistor corresponding to the pixel 6012 exceeds the fusing temperature 605.

Even if the number of pixels adjacent or close in the primary scanning direction and having the high tonal value (H) increases as in the case where all of the pixels 6011 to 6014 have the high tonal value (H) as shown in FIG. 8C, the temperature of the resistor corresponding to the pixel 6012 hardly changes from the case in FIG. 8B.

On the other hand, FIG. 8D shows the case where the pattern in FIG. 8A is repeated in two lines in the secondary scanning direction, and the change in the temperature of the resistor in the first line is the same as in FIG. 8A. After the thermal head is driven for the first line and subsequently the printing paper is conveyed in the secondary scanning direction, the thermal head is driven for the second line. The same resistor is heated for a pixel 6022 in the second line and the pixel 6012 in the first line, but the temperature of the resistor sufficiently decreases by the time of driving the thermal head for the second line, and therefore driving the thermal head for the first line does not influence the temperature of the resistor at the time of the driving the thermal head for the second line. Therefore, the temperature of the resistor does not reach the fusing temperature 605 at the time of driving the thermal head for the second line either.

FIG. 8E shows the case in which the pattern in FIG. 8B is repeated in two lines in the secondary scanning direction, and the changes in the temperature of the resistors for the first line is the same as in FIG. 8B. In this case, even if driving the thermal head for the first line does not influence the temperature of the resistors at the time of driving the thermal head for the second line, the temperature of the resistor 6022 in the second line also exceeds the fusing temperature 605 since the changes in the temperature of the second line is the same as in FIG. 8B. Furthermore, the temperature of the resistor 6012 that rose above the fusing temperature 605 when driving the thermal head for the first line has not sufficiently decreased by the time of driving the thermal head for the second line. Therefore, when driving the thermal head for the second line, the degree of the fusion of the protective sheet 404*h* and the base material 404*i* increases above that for the first line. Note that in FIG. 8E, the highest temperature in the second line is substantially the same as in the first line, because the pulse data has been underwent temperature correction.

For example, it is also theoretically possible to use the data of a pattern image constituted only by pixels of a high tonal value (H) in the case of performing matte finish. However, it is highly possible that the degree of the fusion of the protective sheet 404*h* and the base material 404*i* excessively increases, the binding force between the protective sheet 404*h* and the base material 404*i* exceeds the adhesive force between the adhesive layer 404*g* and the printing paper, and a phenomenon in which the protective sheet 404*h* is not completely separated (insufficient separation) occurs.

On the other hand, a better deglossing effect is obtained when variation in the surface state is larger, for example, as in the case where both glossy surface portions and rough surface portions exist, compared to when making the surface of the protective sheet 404*h* uniformly rough. This is because, when the variation in the surface state is large, light reflected on the surface of the protective sheet 404*h* scatters. Therefore, in this embodiment, the data of the pattern image constituted by pixels of a high tonal value (H) and a low tonal value (L) is used.

Figure 9:
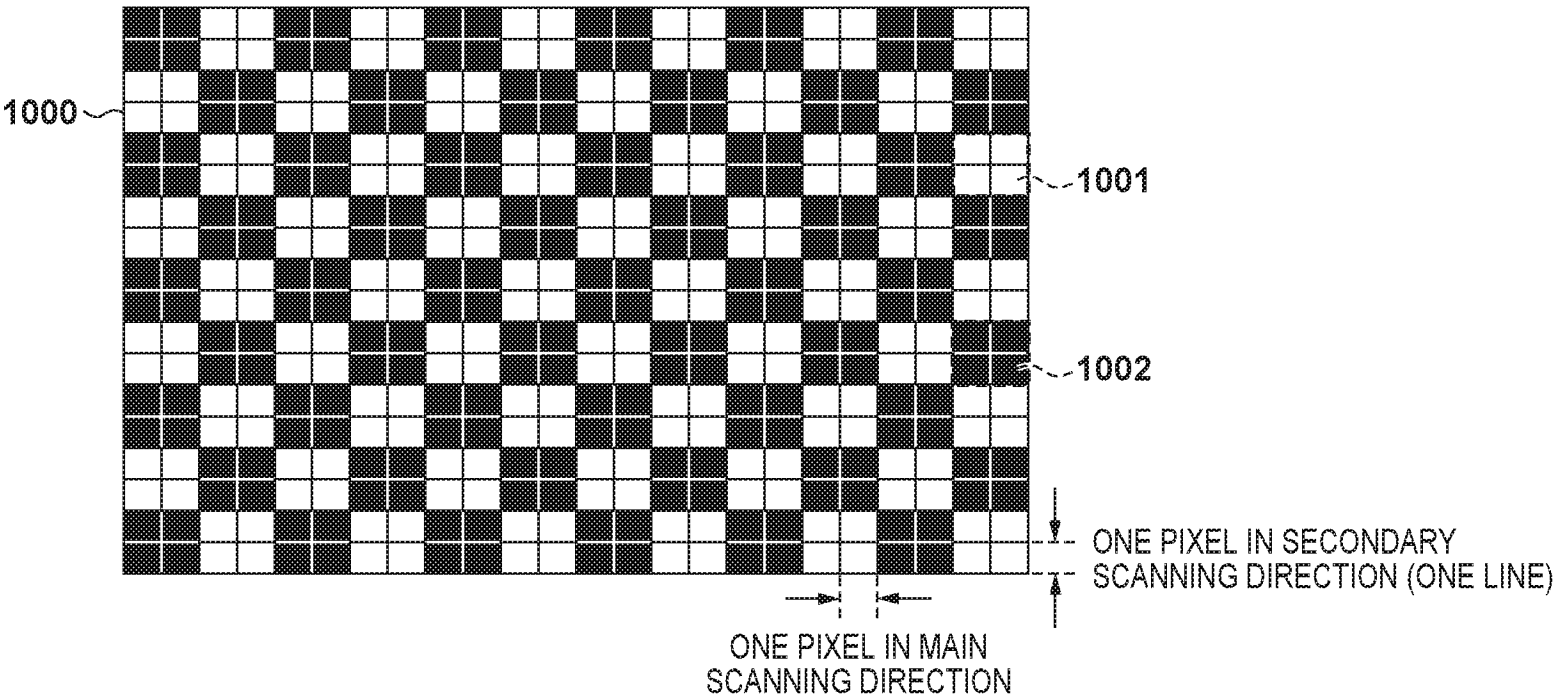
FIG. 9 is a diagram showing an example of a conventional pattern image.

For example, consider the use of data of a pattern image in which pixels with a high tonal value (H) and pixels with a low tonal value (L) form a checkered pattern as shown in FIG. 9. In a pattern image 1000 shown in FIG. 9, rectangular blocks each constituted by 2×2 pixels with a high tonal value (H) (first pixels or high tonal pixels) in the primary scanning direction and in the secondary scanning direction, and rectangular blocks each constituted by 2×2 pixels with a low tonal value (L) (second pixels or low tonal pixels) in the primary scanning direction and in the secondary scanning direction are alternately arranged. Here, assume that white pixels correspond to the high tonal pixels and that black pixels correspond to the low tonal pixels, and a rectangular block 1001 is constituted by the high tonal pixels, and a rectangular block 1002 is constituted by the low tonal pixels. Note that a pattern image serving as a unit of repetition is shown in FIG. 9, but the data of a pattern image corresponding to the entire surface of the printing paper may be stored.

In the case where the protective layer is formed using such a pattern image, the temperature of the resistors in the thermal head at the positions corresponding to the rectangular block 1001 change as shown in FIG. 8E. As was described, regarding the pattern shown in FIG. 8E, the degree of the fusion of the protective sheet 404*h* and the base material 404*i* is larger in the second line than in the first line. This means that the binding force between the protective sheet 404*h* and the base material 404*i* in the secondary scanning direction increases, causing a rise in the probability of occurrence of insufficient separation of the protective sheet 404*h*. According to the inventors' examination, in the case of using the pattern image having a checkered pattern shown in FIG. 9, insufficient separation between the protective sheet 404*h* and the base material 404*i*, and paper jam accompanying the insufficient separation occurred. Therefore, the inventors repeated examinations, and as a result of that, the following was found.

In the case of making the surface of the protective sheet rough by fusing the protective sheet and the base material: (A) a certain size of a fusion area makes reflection light easily scatter, and therefore realizes a better matte effect; and (B) on the other hand, the larger the fusion area in the secondary scanning direction is, the more force is required when separating the protective sheet 404*h* from the base material 404*i*, and therefore if a large number of fusion areas that are large in the secondary scanning direction exist on the same line in the primary scanning direction, insufficient separation easily occurs.

Moreover, as a result of earnest examination in light of such properties, it was found that both a high deglossing effect and suppression of insufficient separation can be realized by using a pattern image constituted by high tonal pixels and low tonal pixels, the pattern image satisfying the following conditions:

(1) the percentage of pixels having a high tonal value (high tonal pixels) and the percentage of pixels having a low value (low tonal pixels) within the total of the pixels constituting the pattern image are each 40% or more;

(2) each pixel line in the pattern image in the primary scanning direction includes at least one area in which two or more high tonal pixels are consecutive; and (3) the percentage of high tonal pixel areas in which two pixels of high tonal data are consecutive in the secondary scanning direction within the total of the pixels constituting the pattern image is less than 50%.

It was also found that it is preferred that one or more of the following conditions are further satisfied:

(3-1) the percentage of pixels that are included in each pixel line in the primary scanning direction and belong to a high tonal pixel block in which two or more high tonal pixels are consecutive in the primary scanning direction and the secondary scanning direction is preferably 30% or less, and more preferably, 20% or less, (3-2) the percentage of pixels that belong to a high tonal pixel area in which two or more high tonal pixels are consecutive in the secondary scanning direction within the total of the pixels constituting the pattern image is 40% or less, and the percentage of pixels that are included in each pixel line in the primary scanning direction and belong to a high tonal pixel area is 50% or less, and (4) the length of one side of an area in which high tonal pixels are consecutive both in the primary scanning direction and the secondary scanning direction is 500 μm or less and 100 μm or more, and preferably 300 μm or less and 100 μm or more.

Note that rough areas and gloss areas are arranged in a balanced manner with the condition 1 among the above-described conditions, and thus large variation in the surface state can be maintained over the entity of the surface, making it possible to obtain a good deglossing effect. The condition 2 is a condition considering mainly A, the condition 3 is a condition considering mainly B, and the conditions 3-1, 3-2 and 4 are conditions considering both A and B.

An example of a specific pattern image that satisfies the above-described conditions will be described below with reference to FIGS. 6A to 7B. Note that in the following description, assume that one pixel is a rectangle that is 80 to 90 μm on each side (300 dpi), and that the pattern image is constituted by high tonal pixels having a tonal value of 220 and low tonal pixels having a tonal value of 100.

Figure 6A:
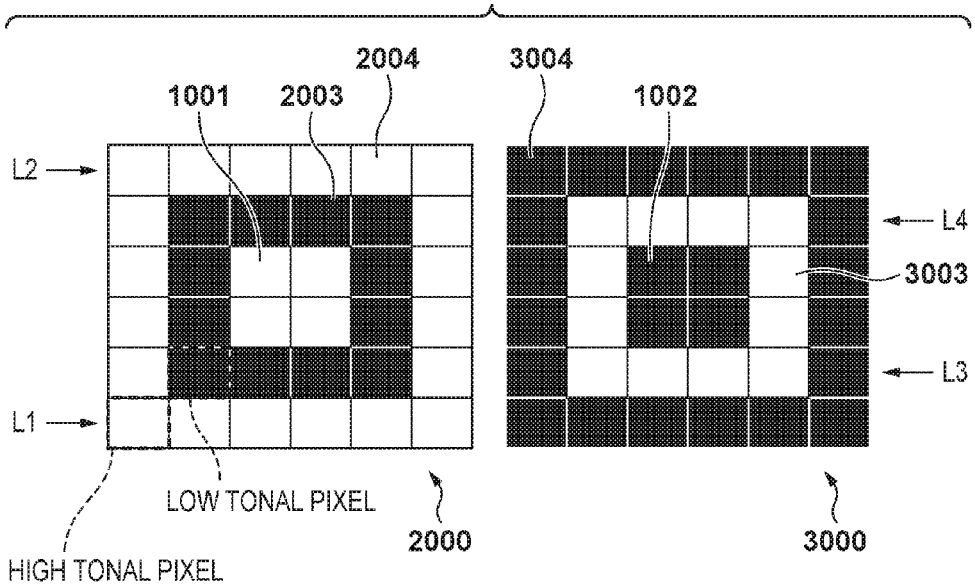
FIGS. 6A and 6B are diagrams showing an example of a pattern image.

FIG. 6A is a diagram showing two types of unit patterns constituting a pattern image according to this embodiment, and pixels corresponding to a high tonal value (high tonal pixels) are indicated in white, and pixels corresponding to a low tonal value (low tonal pixels) are indicated in black. A first pattern 2000 shown on the left and a second pattern 3000 shown on the right have a relationship in which the low tonal pixels and the high tonal pixels are reversed.

The first pattern 2000 is constituted by a rectangular block H 1001 having high tonal pixels, a frame-like group of low tonal pixels (a frame L 2003) surrounding the rectangular block H 1001, and a group of high tonal pixels (a frame H 2004) surrounding the frame L 2003.

The second pattern 3000 is constituted by a rectangular block L 1002 having low tonal pixels, a frame-like group of high tonal pixels (a frame H 3003) surrounding the rectangular block L 1002, and a group of low tonal pixels (a frame L 3004) surrounding the frame H 3003.

The first pattern 2000 and the second pattern 3000 are constituted by 6×6=36 pixels, and the size of each side of the patterns in the primary scanning direction and the secondary scanning direction is 480 to 540 μm. Also, the frame L 2003, the frame H 2004, the frame H 3003 and the frame L 3004 are each formed with a one-pixel width, and thus the width is 80 to 90 μm.

Both the first pattern 2000 and the second pattern 3000 are constituted by 6×6=36 pixels, but the first pattern 2000 includes 24 high tonal pixels, and the second pattern 3000 includes 24 low tonal pixels. In the case where the first pattern 2000 and the second pattern 3000 that are adjacent to each other form one unit of repetition, the percentage of high tonal pixels and the percentage of low tonal pixels within the unit of repetition (72 pixels) are both 50% (36 pixels).

Figure 6B:
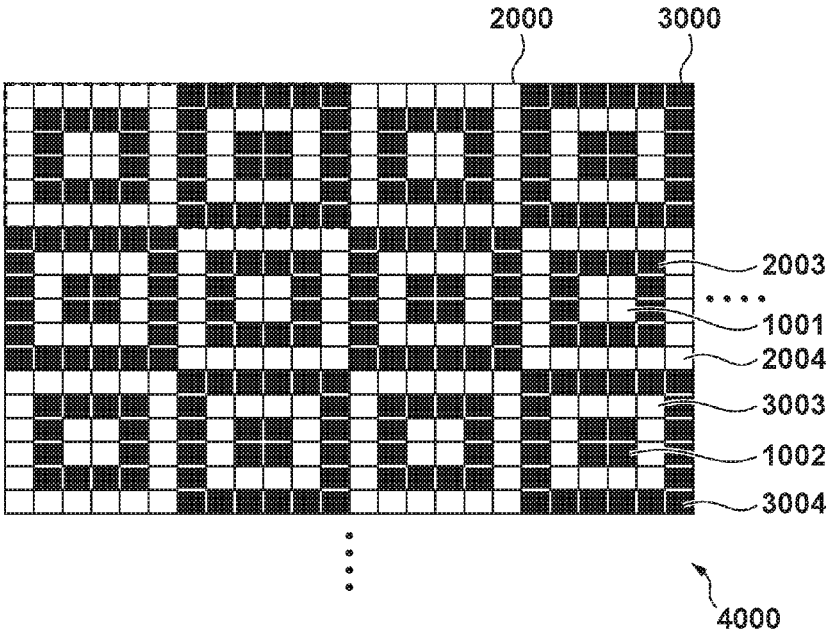

FIG. 6B shows a portion of a pattern image 4000 constituted by the first pattern 2000 and the second pattern 3000 in FIG. 6A. As shown in the figure, the first pattern 2000 and the second pattern 3000 are arranged alternately both in the primary scanning direction (the right-left direction in the drawing) and the secondary scanning direction (the up-down direction in the drawing), and are arranged in a checkered pattern or in a checker-board manner such that the same pattern is not repeated adjacently. At least one unit of repetition including the first pattern 2000 and the second pattern 3000 is stored as a pattern image in the pattern data recording unit 240.

In the case of forming the protective layer using the pattern image 4000, the protective sheet is made rough in the rectangular block H 1001, the frame H 2004 and the frame H 3003 that have consecutive high tonal pixels. In addition, the protective sheet is not made rough in the rectangular block L 1002, the frame L 2003, and the frame L 3004 that have consecutive low tonal pixels, thus maintaining a glossy surface. Because rough surface areas and glossy surface areas exist alternatively at a short cycle, change in the surface state of the protective sheet is large, and a good deglossing effect can be obtained, making it possible to improve the visual recognizability of the printed image.

In the pattern image 4000, the percentage of high tonal pixels and the percentage of low tonal pixels are 50%, and thus the condition 1 is satisfied. In addition, each pixel line in the primary scanning direction includes at least one area that has two or more consecutive high tonal pixels, and thus the condition 2 is satisfied. Furthermore, the percentage of a high tonal pixel area in which two pixels of high tonal data are consecutive in the secondary scanning direction within the total of the pixels constituting the pattern image is 30%, and thus the condition 3 is satisfied.

In addition, the percentage of pixels that are included in each of the pixel lines in the primary scanning direction and belong to a high tonal pixel block in which two or more high tonal pixels are consecutive in the primary scanning direction and the secondary scanning direction is 0 to 17%, and thus the condition (3-1) is also satisfied.

The percentage of pixels that belong to a high tonal pixel area in which two or more high tonal pixels are consecutive in the secondary scanning direction within the total of the pixels constituting the pattern image is 30%, and the percentage of pixels that are included in each of the pixel lines in the primary scanning direction and belong to a high tonal pixel area is 17 to 50%. Therefore, the condition (3-2) is also satisfied.

Furthermore, the length of one side of an area in which high tonal pixels are consecutive both in the primary scanning direction and the secondary scanning direction (here, the rectangular block H 1001) is 160 to 180 μm, and thus the condition (4) is also satisfied.

High tonal pixels that belong to the rectangular block H 1001 make up only about 17% of one line in the primary scanning direction, and thus insufficient separation can be sufficiently suppressed. In addition, a pattern in which two, four, and six high tonal pixels are consecutive in the primary scanning direction and the secondary scanning direction is included, thus making it possible to effectively realizing a rough surface.

Figure 7A:
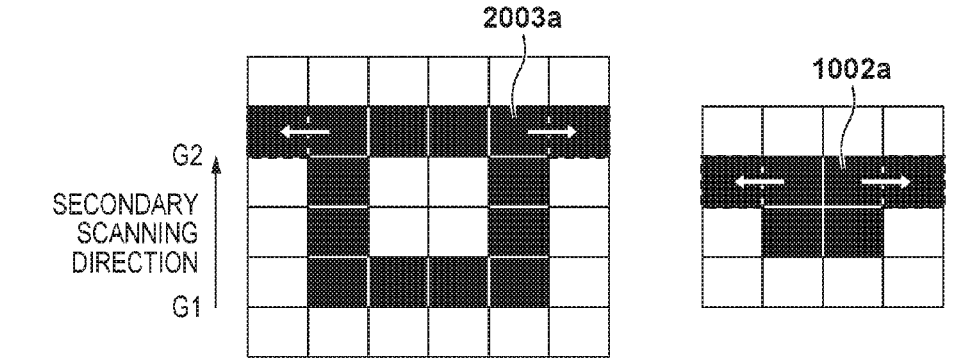
FIGS. 7A and 7B are diagrams showing another example of a pattern image.
Figure 7B:
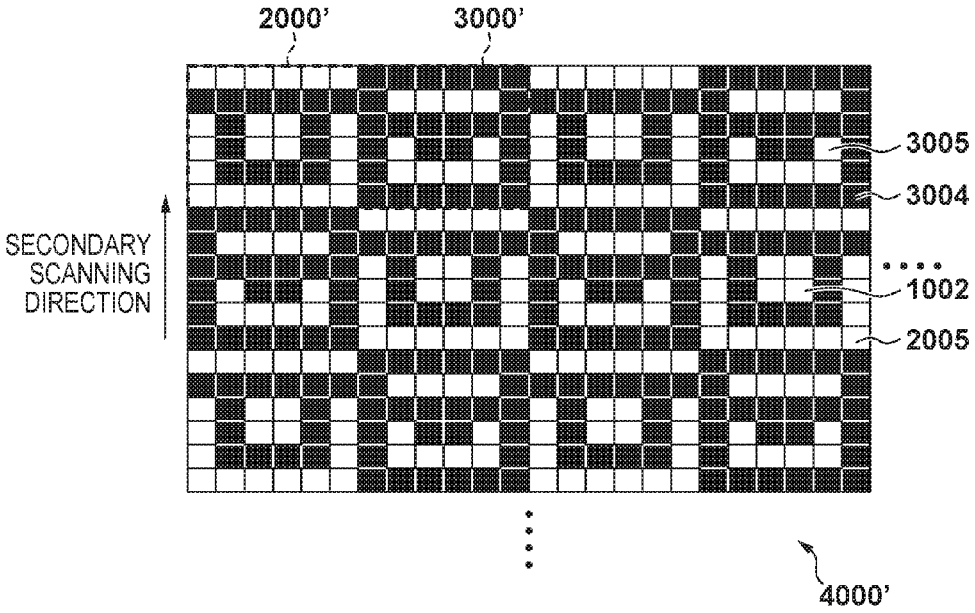

FIGS. 7A and 7B show a modified example of the pattern image shown in FIGS. 6A and 6B. As shown in FIG. 7A, in the modified example, the frame L 2003 and the rectangular block L 1002 are modified, and a frame L 2003*a* and a rectangular block L 1002*a* in which the number of low tonal pixels consecutive in the primary scanning direction is increased are used. Specifically, the modification is made such that out of two sides (pixel lines) making up the frame L 2003 and the rectangular block L 1002 and having low tonal pixels consecutive in the primary scanning direction, one to be used lastly (last in the secondary scanning direction) is extended on two sides. Due to this extension, some pixels of the two sides in the secondary scanning direction of the frame H 2004 and the frame H 3003 become low tonal pixels, thereby separating the high tonal pixels. In FIG. 7A, reference signs G1 and G2 respectively indicate a printing-starting pixel line and a printing-ending pixel line of the frame L 2003*a*.

FIG. 7B shows a pattern image 4000' in which a first pattern 2000' and a second pattern 3000' that are modified are used. FIG. 7B is the same as FIG. 6B except that the frame L 2003*a* and the rectangular block L 1002*a* are used.

The reason for increasing the number of low tonal pixels included in the printing-ending line in the primary scanning direction of the frame L 2003*a* and the rectangular block L 1002*a* in this modified example will be described below. In the case of actually driving the thermal head with the pattern image in FIG. 6B, the degree of fusion to be obtained is different between a line for which the thermal head is driven earlier and a line for which the thermal head is driven later even though the number of high tonal pixels consecutive in the primary scanning direction is the same. Specifically, in the frame H 3003 and the frame H 2004 in FIG. 6A, the degree of fusion due to high tonal pixels consecutive in the primary scanning direction is different between a line for which the thermal head is driven first (L1 and L3) and a line for which the thermal head is driven last (L2 and L4).

This is because the influence of the driving of the thermal head on high tonal pixels included in the lines for which the thermal head has been driven so far is different between the lines L1 and L3 and the lines L2 and L4. In the case where high tonal pixels not consecutive in the primary scanning direction are simply consecutive in the secondary scanning direction as shown in FIG. 8D, heating for the line for which the thermal head is driven earlier does not influence the heating value for pixels in the line for which the thermal head is driven later. However, in the case where high tonal pixels are consecutive in the primary scanning direction in the line for which the thermal head is driven later, pixels near the location in which the direction in which high tonal pixels are consecutive changes from the secondary scanning direction to the primary scanning direction are affected by the influence of the heat accumulation. For example, in the case where in FIG. 8E, the pixels 6012, 6022, and 6023 are high tonal pixels, the pixels 6022 and 6023 are influenced by the heat accumulation, and the degree of fusion increases. In the modified example, in the area in which high tonal pixels included in the line in the primary scanning direction for which the thermal head is driven later are consecutive, high tonal pixels included in a line in the primary scanning direction for which the thermal head is driven immediately before are not adjacent, thereby reducing the difference in the degree of the fusion. Accordingly, the sound at the time of the separation can be reduced more than in the case of using the pattern image in FIGS. 6A and 6B.

Note that the case in which the pitch of the thermal head (dpi) is 300 dpi was described with reference to FIGS. 6A to 7B, but in the case of another pitch, it is sufficient to convert the number of pixels in accordance with the pitch so as to have the same size as with 300 dpi. For example, in the case of a 600 dpi head, it is sufficient to double the number of pixels.

In FIGS. 6A and 6B, the first pattern 2000 and the second pattern 3000 are each a pattern having 6×6 pixels, but may be a pattern having 4×4 pixels. In the case of the 4×4 pixel pattern, preferably, a first pattern is constituted by the rectangular block 1001 of high tonal pixels and a low tonal pixel frame 2003 surrounding the rectangular block 1001, and a second pattern is constituted by the rectangular block 1002 of low tonal pixels and a high tonal pixel frame 3003 surrounding the rectangular block 1002. Similarly, a modified pattern of the pattern in FIGS. 7A and 7B may be a pattern of 4×4 pixels.

Working Examples

Evaluation 1

Protective sheets 404*h* (i.e., protective ink layers 404*f*) were printed (heat-transferred) under the same conditions except for the image data that was used, and glossiness, visual recognizability, and insufficient separation were compared and evaluated.

Specifically, as image data used for printing the protective sheet 404*h*, (1) a pattern image having high tonal pixels for the entire image, (2) the pattern image 1000, and (3) the pattern image 4000 were used. Subsequently, the tonal value of the low tonal pixels was fixed at 89, the tonal value of the high tonal pixels was changed in 13 ways, that is to say was set to 100, every 10 tones from 150 to 250, and 255, the protective sheets 404*h* were printed, and the glossiness of the surface of the printing paper onto which the protective sheets had been transferred was measured. Note that in the case of using a pattern image having high tonal pixels for the entire image, a low tonal value is not used.

In a state in which a new ink cassette (RP-54 manufactured by Cannon Inc.) was mounted to a sublimation printer (SELPHY CP820 manufactured by Cannon Inc.), printing was performed at the room temperature of 25 degrees, with the electric power supplied to the head being 89 mW, and at a protective sheet transferring speed of 0.3 ips, while changing the pattern images. Glossiness is a numeral value measured using a gloss meter (micro-haze plus manufactured by BYK) by a method conforming to Method 5 of JISZ 8741 (20° specular gloss), and is a relative value when the glossiness of a glass surface (the refractive index is 1.567 over the total visible wavelength range) is 100(%).

Difference in gloss can be sufficiently recognized when glossiness differs by 10 or more. In addition, from the viewpoint of the visual recognizability of a printed image, the smaller the glossiness is, the better the visual recognizability is. The average value of glossiness when gloss finish is applied is 50, and thus if the glossiness after applying matte finish is 40 or less, improvement of visual recognizability over gloss finish can be sufficiently recognized. The more the glossiness further decreases, the more the visual recognizability improves. Therefore, glossiness when matte finish is applied (in the case of using the pattern image 1000 or 4000) needs to be 40 or less, preferably 30 or less, and more preferably 25 or less.

Moreover, insufficient separation was evaluated by visually checking whether or not a trace different from a pattern image used for printing or the like existed on the surface of the protective sheet 404*h*.

Measurement and evaluation results are shown in Table 1 below.

TABLE 1

| Tonal value of high tonal pixels | High tonal pixels for entire image | | Pattern image 1000 (FIG. 9) | | Pattern image 4000 (FIG. 6) | |
|---|---|---|---|---|---|---|
| | Glossiness | Visual recognizability | Glossiness | visual recognizability | Glossiness | Visual recognizability |
| 100 | 50 | Poor | 50 | Poor | 50 | Poor |
| 150 | 50 | Poor | 49 | Poor | 50 | Poor |
| 160 | 49 | Poor | 49 | Poor | 50 | Poor |
| 170 | 49 | Poor | 49 | Poor | 49 | Poor |
| 180 | 48 | Poor | 48 | Poor | 49 | Poor |
| 190 | 46 | Poor | 45 | Poor | 48 | Poor |
| 200 | 36 | Good | 40 | Good | 45 | Poor |
| 210 | 25 | Very good | 35 | Good | 40 | Good |
| 220 | 11 | Very good | 27 | Very good | 37 | Good |
| 230 | Insufficient separation | — | 18 | Very good | 33 | Good |
| 240 | Insufficient separation | — | Insufficient separation | — | 27 | Very good |
| 250 | Insufficient separation | — | Insufficient separation | — | 22 | Very good |
| 255 | Insufficient separation | — | Insufficient separation | — | 18 | Very good |

As seen from Table 1, insufficient separation occurred when the tonal value of high tonal pixels was 230 or more in the case of using a pattern image having high tonal pixels for the entire image, and when the tonal value of high tonal pixels was 240 or more in the case of using the pattern image 1000. However, insufficient separation did not occur even when the tonal value of high tonal pixels was 255 in the case of using the pattern image 4000.

In addition, good visual recognizability is obtained when the tonal value of the high tonal pixels is in the range of 200 to 220 in the case of the pattern image having high tonal pixels for the entire image, and when the tonal value of the high tonal pixels is in the range of 200 to 230 in the case of the pattern image 1000. On the other hand, in the case of the pattern image 4000, good visual recognizability was obtained when the tonal value of the high tonal pixels was in the range of 210 or more (210 to 255). In other words, the pattern image 4000 has a broad range of tonal values of the high tonal pixels at which good visual recognizability is obtained. Moreover, it is seen that visual recognizability equivalent to that for the pattern image 1000 can be realized.

Evaluation 2

Next, the rate of occurrence of insufficient separation during continuous printing was evaluated. In the case of performing continuous printing, insufficient separation easily occurs due to the rise in the temperatures of thermal head and the environment. In addition, when the diameter of the winding bobbin 407 increases as the printing procedure proceeds, the winding torque of the ink sheet decreases and the separation timing becomes delayed, still allowing insufficient separation to easily occur. Therefore, as the ink cassette becomes used up due to continuous printing, insufficient separation easily occurs synergistically.

In view of this, glossiness and insufficient separation were evaluated in the case where continuous printing of 54 sheets was performed. Here, the tonal value of high tonal pixels was set to 220 at which a good value was obtained with each of the pattern images in Evaluation 1, and 248 at which only the pattern image 4000 did not cause insufficient separation to occur. The pattern image 4000' shown in FIGS. 7A and 7B was also evaluated. The other conditions are same as in Evaluation 1.

Measurement and evaluation results are shown in Table 2 below.

TABLE 2

| | Tonal value of high tonal pixels | Tonal value of low tonal pixels | Number of occurrences of insufficient separation during continuous printing of 54 sheets |
|---|---|---|---|
| High tonal pixels for entire image | 220 | — | 35 |
| Pattern image 1000 (FIG. 9) | 220 | 89 | 7 |
| Pattern image 4000 (FIG. 6) | 220 | 89 | 0 |
| Pattern image 4000' (FIG. 7) | 220 | 89 | 0 |
| Pattern image 4000 (FIG. 6) | 248 | 89 | 23 |
| Pattern image 4000' (FIG. 7) | 248 | 89 | 3 |

In the case where the tonal value of high tonal pixels was set to 220 and the tonal value of low tonal pixels was set to 89, insufficient separation occurred in 35 sheets out of 54 sheets in the case of using high tonal pixels for the entire image, and 7 sheets out of 54 sheets in the case of using the pattern image 1000. In contrast, in the case of using the pattern images 4000 and 4000', insufficient separation did not occur in any sheet. In this manner, by printing the protective sheet using the pattern image of this embodiment, suppression of insufficient separation in the protective sheet and improvement of the visual recognizability of the printed article can be realized.

In addition, in order to compare the pattern images 4000 and 4000', similar evaluation was performed with the tonal value of the high tonal pixels being set to 248 at which insufficient separation more easily occurs. As shown in Table 2, insufficient separation occurred in 23 sheets out of 54 sheets in the case where the pattern image 4000 was used, and insufficient separation occurred in 3 sheets out of 54 sheets in the case where the pattern image 4000' was used. In addition, the average glossiness was 18 in the case of using the pattern image 4000, and 20 in the case of using the pattern image 4000'. Therefore, it was found that the pattern image 4000' was a pattern image with which insufficient separation was unlikely to occur regardless of the fact that glossiness did not change very much compared to the pattern image 4000.

In this manner, in this embodiment, in the printing device for fusing the protective sheet and the base material of the ink sheet using the thermal head so as to make the surface of the protective sheet rough, the thermal head is driven with a pattern image that satisfies specific conditions. In particular, a pattern image is used in which (1) there is no large difference between the percentage of high tonal pixels and the percentage of low tonal pixels, (2) each line in the primary scanning direction has an area having consecutive high tonal pixels, and (3) the percentage of an area in which high tonal pixels included in the same line in the primary scanning direction are consecutive in the primary scanning and secondary scanning directions is less than 50%. By using such a pattern image, suppression of insufficient separation of the protective sheet and improvement of the visual recognizability of a printed article can be realized.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-83705, filed on Apr. 15, 2015, which is hereby incorporated by reference herein in its entirety.

What is claimed is:

1. A printing device comprising:

a thermal head that transfers overcoat ink provided on an ink sheet onto a surface of a printing paper; and a controller that causes the thermal head to perform the transfer based on pattern data, wherein the pattern data is data in which a first pattern and a second pattern are arranged alternately in a primary scanning direction and a secondary scanning direction, the first pattern includes a rectangular block of high tonal value pixels, a frame-like group of low tonal value pixels surrounding the rectangular block, of high tonal value pixels and a frame-like group of high tonal value pixels surrounding the frame-like group of low tonal value pixels, and the second pattern includes a rectangular block of low tonal value pixels, a frame-like group of high tonal value pixels surrounding the rectangular block, of low tonal value pixels and a frame like group of low tonal value pixels surrounding the group of high tonal value pixels, wherein each of the low tonal value and the high tonal value is a value that allows the overcoat ink to be transferred onto the printing paper, and the high tonal value is a value that causes glossiness of a surface of the overcoat ink to be transferred onto the printing paper, to be lower than when it is transferred by the low tonal value.

2. The printing device according to claim 1, wherein the first pattern is constituted by a rectangular block of high tonal value pixels, a frame-like group of low tonal value pixels surrounding the rectangular block, of high tonal value pixels and a frame-like group of high tonal value pixels surrounding the group of low tonal value pixels, and the second pattern is constituted by a rectangular block of low tonal value pixels, a frame-like group of high tonal value pixels surrounding the rectangular block, of low tonal value pixels and a frame-like group of low tonal value pixels surrounding the group of high tonal value pixels.

3. The printing device according to claim 1, wherein the frame-like group of low tonal value pixels and the frame-like group of high tonal value pixels in the first pattern and the frame-like group of high tonal value pixels and the frame-like group of low tonal value pixels in the second pattern each have a one-pixel width.

4. The printing device according to claim 1, wherein the second pattern is a pattern in which arrangement of the high tonal value pixels and the low tonal value pixels in the first patterned.

5. The printing device according to claim 1, wherein the length of one side of the rectangular block of high tonal value pixels in the first pattern and the length of one side of the rectangular block of low tonal value pixels in the second pattern are 300 μm or less and 100 μm or more.

6. The printing device according to claim 1, wherein a size of the first pattern and a size of the second pattern in the primary scanning direction and the secondary scanning direction are 480 to 540 μm.

7. The printing device according to claim 1, wherein the first pattern is constituted by a first rectangular block of high tonal value pixels, a frame-like group of low tonal value pixels surrounding the first rectangular block, of high tonal value pixels and a pixel group in which a portion of pixels of a side in the secondary scanning direction of a frame-like group of high tonal value pixels surrounding the frame-like group of low tonal value pixels is a low tonal value pixel, and the second pattern is constituted by a second rectangular block of low tonal value pixels, a pixel group in which a portion of pixels of a side in the secondary scanning direction of a frame-like group of high tonal value pixels surrounding the second rectangular block of low tonal value pixels is a low tonal value pixel, and a frame like group of low tonal value pixels surrounding the pixel group.

8. The printing device according to claim 7, wherein in the first pattern, in the pixel group in which a portion of pixels in the frame-like group of high tonal value pixels is a low tonal value pixel, the low tonal value pixel is arranged such that high tonal value pixels consecutive in the secondary scanning direction and high tonal value pixels that are located downstream the secondary scanning direction and are consecutive in the primary scanning direction are separated.

9. The printing device according to claim 7, wherein in the second pattern, in the pixel group in which a portion of the pixels in the frame-like group of high tonal value pixels is a low tonal value pixel, the low tonal value pixel is arranged such that high tonal value pixels consecutive in the secondary scanning direction and high tonal value pixels that are located downstream in the secondary scanning direction and are consecutive in the primary scanning direction are separated.

10. The printing device according to claim 1, wherein the frame-like group of low tonal value pixels and the frame-like group of high tonal value pixels in the first pattern, and the frame-like group of high tonal value pixels and the frame-like group of low tonal value pixels in the second pattern each have with a one-pixel width.

11. The printing device according to claim 1, wherein the rectangular block of high tonal value pixels in the first pattern and the rectangular block of low tonal value pixels in the second pattern are each constituted by a plurality of pixels.

* * * * *